US011696371B2

(12) United States Patent
Vanko

(10) Patent No.: US 11,696,371 B2
(45) Date of Patent: Jul. 4, 2023

(54) INDUCTION HEATING ASSEMBLY FOR A VAPOUR GENERATING DEVICE

(71) Applicant: JT International S.A., Geneva (CH)

(72) Inventor: Daniel Vanko, Watford (GB)

(73) Assignee: JT International S.A.

( * ) Notice: Subject to any disclaimer, the term of this patent is extended or adjusted under 35 U.S.C. 154(b) by 419 days.

(21) Appl. No.: 16/651,707

(22) PCT Filed: Dec. 20, 2018

(86) PCT No.: PCT/EP2018/086170

§ 371 (c)(1),
(2) Date: Mar. 27, 2020

(87) PCT Pub. No.: WO2019/129637

PCT Pub. Date: Jul. 4, 2019

(65) Prior Publication Data

US 2020/0253283 A1 Aug. 13, 2020

(51) Int. Cl.

| | |
|---|---|
| ***A24F 13/00*** | (2006.01) |
| ***H05B 6/10*** | (2006.01) |
| ***A24F 40/465*** | (2020.01) |
| *A24F 40/20* | (2020.01) |

(52) U.S. Cl.
CPC ..... *H05B 6/108* (2013.01); *A24F 40/465* (2020.01); *A24F 40/20* (2020.01)

(58) Field of Classification Search
CPC ..... A24F 47/00
USPC ..... 131/328–329
See application file for complete search history.

(56) References Cited

U.S. PATENT DOCUMENTS

| | | | | |
|---|---|---|---|---|
| 9,717,277 | B2 * | 8/2017 | Mironov | H05B 6/36 |
| 2019/0239566 | A1 | 8/2019 | Alarcon et al. | |

FOREIGN PATENT DOCUMENTS

| | | | |
|---|---|---|---|
| CN | 106998808 | A | 8/2017 |
| EP | 3243395 | A2 | 11/2017 |
| GB | 2543329 | A | 4/2017 |
| JP | H1050522 | A | 2/1998 |
| JP | 2001110639 | A | 4/2001 |
| JP | 201186009 | A | 4/2011 |
| JP | 2016510994 | A | 4/2016 |
| JP | 2016528874 | A | 9/2016 |
| WO | 2014159250 | A1 | 10/2014 |
| WO | 2015177253 | A1 | 11/2015 |

OTHER PUBLICATIONS

International Search Report for Application No. PCT/EP2018/086170 dated Apr. 18, 2019, 2 pages.
Search Report completed Jan. 10, 2023 from Taiwanese Office Application No. 107146065 dated Jan. 11, 2023. 2 pgs.

* cited by examiner

*Primary Examiner* — Phuong K Dinh
(74) *Attorney, Agent, or Firm* — Lerner David LLP

(57) ABSTRACT

An induction heating assembly for a vapour generating device includes an induction coil and a low-pass filter positioned adjacent to the induction coil. The low-pass filter is electrically connected to the induction coil to act as a low-pass filter for the induction coil and is shaped to extend substantially across at least one side of the induction coil to provide an electromagnetic shield for the induction coil.

13 Claims, 3 Drawing Sheets

INDUCTION HEATING ASSEMBLY FOR A VAPOUR GENERATING DEVICE

CROSS-REFERENCE TO RELATED APPLICATIONS

The present application is a national phase entry under 35 U.S.C. § 371 of International Application No. PCT/EP2018/086170, filed Dec. 20, 2018, published in English, which claims priority to European Application No. 17210815.1 filed Dec. 28, 2017, the disclosures of which are incorporated herein by reference.

TECHNICAL FIELD

The present disclosure relates to an induction heating assembly for a vapour generating device. Embodiments of the present disclosure also relate to a vapour generating device.

TECHNICAL BACKGROUND

Devices which heat, rather than burn, a vaporisable substance to produce a vapour for inhalation have become popular with consumers in recent years.

Such devices can use one of a number of different approaches to provide heat to the substance. One such approach is to provide a vapour generating device which employs an induction heating system. In such a device, an induction coil (hereinafter also referred to as an inductor) is provided with the device and a susceptor is provided with the vaporisable substance. Electrical energy is provided to the inductor when a user activates the device which in turn generates an alternating electromagnetic field. The susceptor couples with the electromagnetic field and generates heat which is transferred, for example by conduction, to the vaporisable substance and vapour is generated as the vaporisable substance is heated.

Such an approach has the potential to provide better control of heating and therefore vapour generation. However, a shortcoming of the use of an induction heating system is that leakage of the electromagnetic field generated by the induction coil may occur and there is, therefore, a need to address this shortcoming.

SUMMARY OF THE DISCLOSURE

According to a first aspect of the present disclosure, there is provided an induction heating assembly for a vapour generating device, the induction heating assembly comprising:

an induction coil; and a low-pass filter positioned adjacent to the induction coil and shaped to extend substantially across at least one side of the induction coil.

The low-pass filter is electrically connected to the induction coil to act as a low-pass filter for the induction coil. The low-pass filter is also structured to provide an electromagnetic shield for the induction coil. In this way, a single electronic component can be provided to act as both a low-pass filter of electronic control circuitry of the induction heating assembly and as an electromagnetic shield. The construction of the induction heating assembly is thus simplified due to the need to use fewer electronic components. The use of fewer electronic components leads to a reduction in both the size and the manufacturing cost of the induction heating assembly.

According to a second aspect of the present disclosure, there is provided a vapour generating device comprising:

an induction heating assembly according to the first aspect of the present disclosure;

a power source arranged to provide power to the induction coil;

a heating compartment arranged to receive an induction heatable cartridge;

an air inlet arranged to provide air to the heating compartment; and an air outlet in communication with the heating compartment.

The induction heating assembly may comprise a power source, for example a battery, arranged to provide power to the induction coil. The induction heating assembly may comprise a heating compartment in communication with an air outlet. The heating compartment may be arranged to receive an induction heatable cartridge.

The low-pass filter may be positioned between the induction coil and the power source.

The low-pass filter may be positioned between the induction coil and the air outlet.

The induction heating assembly may comprise an air inlet in communication with the heating compartment and the low-pass filter may be positioned between the air inlet and the power source. Such an arrangement allows the provision of a compact induction heating assembly and, hence, of a compact vapour generating device.

The induction heating assembly may comprise one or more resonant capacitors, and the low-pass filter may be positioned between the induction coil and the one or more resonant capacitors. The one or more resonant capacitors are, thus, protected from electromagnetic exposure.

The low-pass filter may comprise a coil. The low-pass filter coil may comprise a flat coil which may extend in a plane defined by the coil winding direction.

The induction coil may be helical.

The low-pass filter coil may be positioned at an axial end of the helical induction coil. The plane of the low-pass filter coil may be substantially perpendicular to the axial direction of the helical induction coil.

The low-pass filter may be arranged to substantially cover an elongate side of the helical induction coil.

The low-pass filter may comprise a plate member comprising a ferrimagnetic material and the low-pass filter coil may be positioned on the plate member. Such an arrangement increases the inductance of the low-pass filter and EM shield performance.

The low-pass filter may comprise two plate members comprising a ferrimagnetic material and the low-pass filter coil may be positioned between the plate members. Such an arrangement again increases the inductance of the low-pass filter and EM shield performance.

The or each ferrimagnetic plate member may be circular, for example may comprise a ferrimagnetic disk, although other shapes can be employed.

The or each ferrimagnetic plate member may comprise a ferrimagnetic material having a low electrical conductivity and a high magnetic permeability, for example a ferrite ceramic.

The induction heating assembly may be arranged to operate in use with a fluctuating electromagnetic field having a magnetic flux density of between approximately 20 mT and approximately 2.0 T at the point of highest concentration.

The induction heating assembly may include a power source and circuitry which may be configured to operate at a high frequency. The power source and circuitry may be configured to operate at a frequency of between approximately 80 kHz and 500 kHz, possibly between approximately 150 kHz and 250 kHz, and possibly at approximately 200 kHz. The power source and circuitry could be configured to operate at a higher frequency, for example in the MHz range, depending on the type of inductively heatable susceptor that is used.

The low-pass filter may have a cut-off frequency between approximately 100 kHz and 600 kHz. In some embodiments, the low-pass filter may have a cut-off frequency of approximately 250 kHz. In other embodiments, the low-pass filter may have a cut-off frequency between approximately 280 kHz and 300 kHz.

Whilst the induction coil may comprise any suitable material, typically the induction coil may comprise a Litz wire or a Litz cable.

Whilst the induction heating assembly may take any shape and form, it may be arranged to take substantially the form of the induction coil, to reduce excess material use. As noted above, the induction coil may be substantially helical in shape.

The circular cross-section of a helical induction coil facilitates the insertion of an induction heatable cartridge into the induction heating assembly and ensures uniform heating of the induction heatable cartridge. The resulting shape of the induction heating assembly is also comfortable for the user to hold.

The induction heatable cartridge may comprise one or more induction heatable susceptors. The or each susceptor may comprise one or more, but not limited, of aluminium, iron, nickel, stainless steel and alloys thereof, e.g. Nickel Chromium or Nickel Copper. With the application of an electromagnetic field in its vicinity, the or each susceptor may generate heat due to eddy currents and magnetic hysteresis losses resulting in a conversion of energy from electromagnetic to heat.

The induction heatable cartridge may comprise a vapour generating substance inside an air permeable shell. The air permeable shell may comprise an air permeable material which is electrically insulating and non-magnetic. The material may have a high air permeability to allow air to flow through the material with a resistance to high temperatures. Examples of suitable air permeable materials include cellulose fibres, paper, cotton and silk. The air permeable material may also act as a filter. Alternatively, the induction heatable cartridge may comprise a vapour generating substance wrapped in paper. Alternatively, the induction heatable cartridge may comprise a vapour generating substance held inside a material that is not air permeable, but which comprises appropriate perforations or openings to allow air flow. Alternatively, the induction heatable cartridge may consist of the vapour generating substance itself. The induction heatable cartridge may be formed substantially in the shape of a stick.

The vapour generating substance may be any type of solid or semi-solid material. Example types of vapour generating solids include powder, granules, pellets, shreds, strands, particles, gel, strips, loose leaves, cut filler, porous material, foam material or sheets. The substance may comprise plant derived material and in particular, the substance may comprise tobacco.

The vapour generating substance may comprise an aerosol-former. Examples of aerosol-formers include polyhydric alcohols and mixtures thereof such as glycerine or propylene glycol. Typically, the vapour generating substance may comprise an aerosol-former content of between approximately 5% and approximately 50% on a dry weight basis. In some embodiments, the vapour generating substance may comprise an aerosol-former content of approximately 15% on a dry weight basis.

Also, the vapour generating substance may be the aerosol-former itself. In this case, the vapour generating substance may be a liquid. Also, in this case, the induction heatable cartridge may include a liquid retaining substance (e.g. a bundle of fibres, porous material such as ceramic, etc.) which retains the liquid to be vaporized and allows a vapour to be formed and released/emitted from the liquid retaining substance, for example towards the air outlet for inhalation by a user.

Upon heating, the vapour generating substance may release volatile compounds. The volatile compounds may include nicotine or flavour compounds such as tobacco flavouring.

Since the induction coil produces an electromagnetic field when operating to heat a susceptor, any member comprising an induction heatable susceptor will be heated when placed in proximity to the induction coil in operation, and as such there is no restriction on the shape and form of the induction heatable cartridge being received in the heating compartment. In some embodiments, the induction heatable cartridge may be cylindrical in shape and as such the heating compartment is arranged to receive a substantially cylindrical vaporisable article.

The ability of the heating compartment to receive a substantially cylindrical induction heatable cartridge to be heated is advantageous as, often, vaporisable substances and tobacco products in particular, are packaged and sold in a cylindrical form.

DETAILED DESCRIPTION OF EMBODIMENTS

Embodiments of the present disclosure will now be described by way of example only and with reference to the accompanying drawings.

Figure 1:
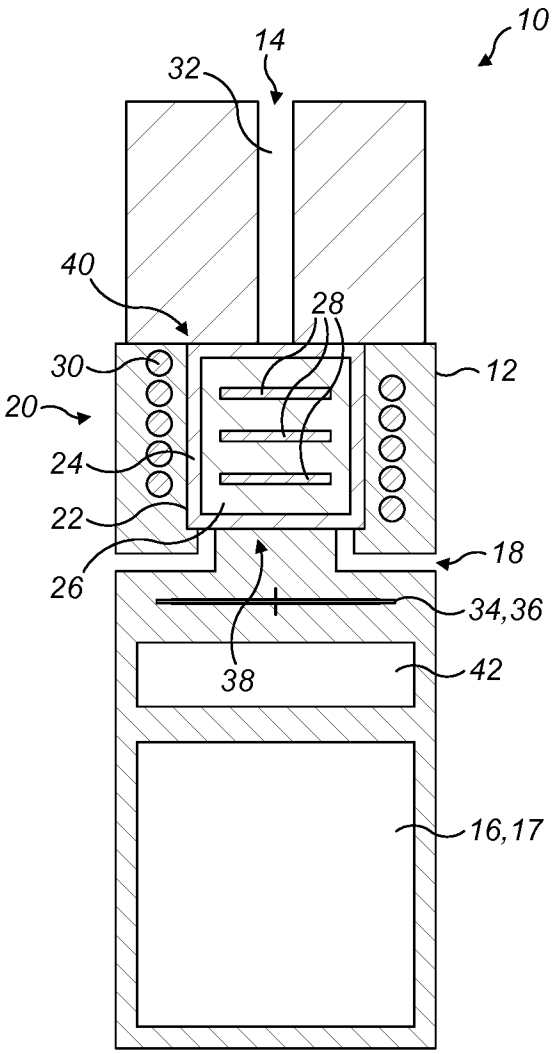
FIG. 1 is a diagrammatic illustration of a vapour generating device comprising an induction heating assembly according to a first embodiment of the present disclosure.

Referring initially to FIG. 1, there is shown diagrammatically a vapour generating device 10 according to an example of the present disclosure. The vapour generating device 10 comprises a housing 12, part of which is shown in FIG. 1. When the device 10 is used for generating vapour to be inhaled, a mouthpiece (not shown) may be installed on the device 10 at an air outlet 14. The mouthpiece provides the ability for a user to easily inhale vapour generated by the device 10. The device 10 includes a power source 16 and control circuitry 17 which may be configured to operate at high frequency. The power source 16 typically comprises one or more batteries which could, for example, be inductively rechargeable. The device 10 also includes a plurality of air inlets 18.

The vapour generating device 10 comprises an induction heating assembly 20 for heating a vapour generating (i.e. vaporisable) substance. The induction heating assembly 20 comprises a generally cylindrical heating compartment 22 which is arranged to receive a correspondingly shaped generally cylindrical induction heatable cartridge 24 comprising a vaporisable substance 26 and one or more induction heatable susceptors 28. The induction heatable cartridge 24 typically comprises an outer layer or membrane to contain the vaporisable substance 26, with the outer layer or membrane being air permeable. For example, the induction heatable cartridge 24 may be a disposable cartridge 24 containing tobacco and at least one induction heatable susceptor 28.

The induction heating assembly 20 comprises a helical induction coil 30, having first and second axial ends 38, 40, which extends around the cylindrical heating compartment 22 and which can be energised by the power source 16 and control circuitry 17. The control circuitry 17 includes, amongst other electronic components, an inverter which is arranged to convert a direct current from the power source 16 into an alternating high-frequency current for the induction coil 30. As will be understood by those skilled in the art, when the induction coil 30 is energised by the alternating high-frequency current, an alternating and time-varying electromagnetic field is produced. This couples with the one or more induction heatable susceptors 28 and generates eddy currents and/or hysteresis losses in the one or more induction heatable susceptors 28 causing them to heat up. The heat is then transferred from the one or more induction heatable susceptors 28 to the vaporisable substance 26, for example by conduction, radiation and convection.

The induction heatable susceptor(s) 28 can be in direct or indirect contact with the vaporisable substance 26, such that when the susceptors 28 is/are inductively heated by the induction coil 30 of the induction heating assembly 20, heat is transferred from the susceptor(s) 28 to the vaporisable substance 26, to heat the vaporisable substance 26 and produce a vapour. The vaporisation of the vaporisable substance 26 is facilitated by the addition of air from the surrounding environment through the air inlets 18. The vapour generated by heating the vaporisable substance 26 then exits the heating compartment 22 through the air outlet 14 and may, for example, be inhaled by a user of the device 10 through the mouthpiece. The flow of air through the heating compartment 22, i.e. from the air inlets 18, through the heating compartment 22, along an inhalation passage 32 of the induction heating assembly 20, and out of the air outlet 14, can be aided by negative pressure created by a user drawing air from the air outlet 14 side of the device 10 using the mouthpiece.

Figure 3B:
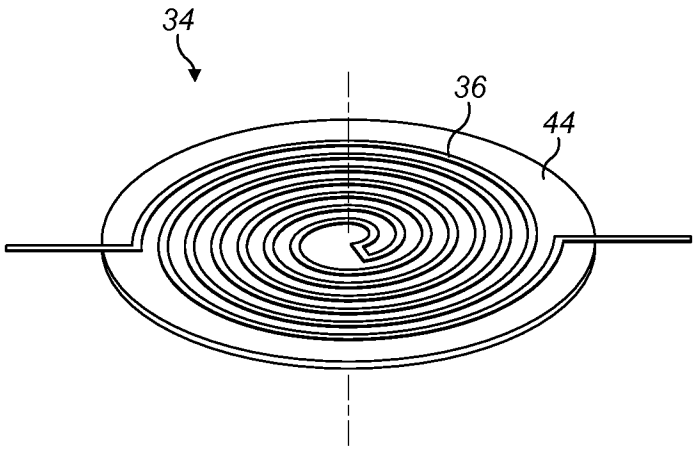
FIGS. 3*a* and 3*b* are diagrammatic illustrations of a first example of a low-pass filter of the induction heating assembly of FIGS. 1 and 2.
Figure 3A:
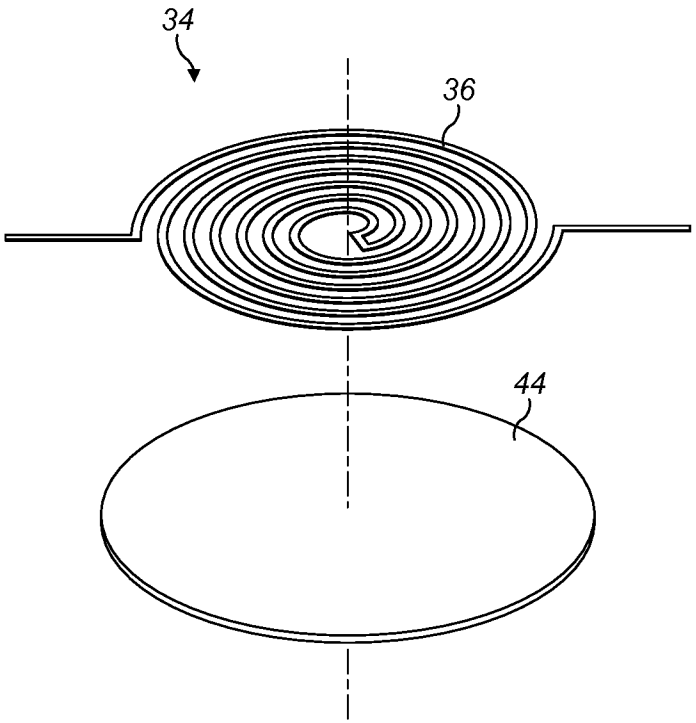

The induction heating assembly 20 comprises a low-pass filter 34 electrically connected to the induction coil 30. The low-pass filter 34 acts as a low-pass filter for the induction coil 30 and is structured to provide an electromagnetic shield for the induction coil 30 to thereby reduce leakage of the electromagnetic field generated by the induction coil 30. The low-pass filter 34 typically comprises a flat coil 36, for example as illustrated in FIG. 3*a*, which extends in a plane defined by the coil winding direction.

In the embodiment illustrated in FIG. 1, the low-pass filter 34 is positioned at the first axial end 38 of the induction coil 30 and the plane of the low pass-filter coil 36 is substantially perpendicular to the axial direction of the induction coil 30. In this position, it will be seen that the low-pass filter coil 36 extends substantially across a side of the induction coil 30 at the first axial end 38 thereof and that the low-pass filter coil 36 is positioned between the induction coil 30 and the power source 16 and also between the air inlets 18 and the power source 16.

In the illustrated embodiment, the induction heating assembly 20 includes one or more resonant capacitors 42, and the low-pass filter coil 36 is advantageously positioned between the induction coil 30 and the one or more resonant capacitors 42 to protect the resonant capacitor(s) 42 from exposure to the electromagnetic field generated by the induction coil 30.

Figure 2:
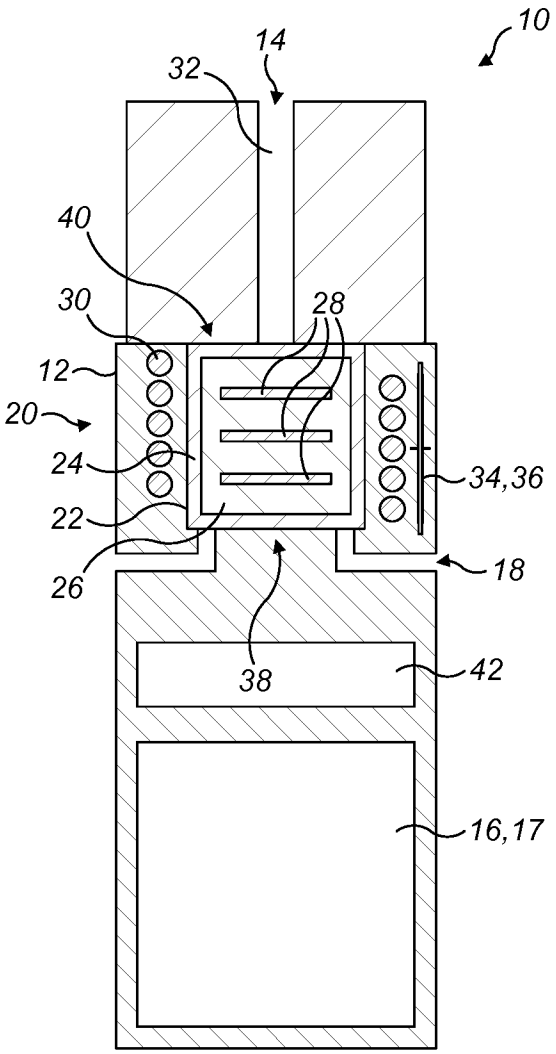
FIG. 2 is a diagrammatic illustration of a vapour generating device comprising an induction heating assembly according to a second embodiment of the present disclosure.

In another embodiment illustrated in FIG. 2, the coil 36 that forms the low-pass filter 34 is positioned so that it substantially covers an elongate side of the induction coil 30, with the plane of the low-pass filter coil 36 arranged so that it is substantially parallel to the axial direction of the helical induction coil 30.

As mentioned above, and with reference to FIGS. 3*a* and 3*b*, the low-pass filter 34 typically comprises a flat coil 36. The low-pass filter 34 further comprises a ferrimagnetic plate member in the form of a ferrimagnetic disk 44, for example of circular section corresponding to the winding configuration of the low-pass filter coil 36. The low pass filter coil 36 is mounted on the disk 44 as shown in FIG. 3*b* and the disk 44 acts as a magnetic core which increases the inductance of the low-pass filter 34. As will be understood by those skilled in the art, the part of the coil 36 that extends radially outwardly from the centre region of the coil 36 does not contact the underlying circumferentially extending parts of the coil 36 that lie beneath it.

Figure 4B:
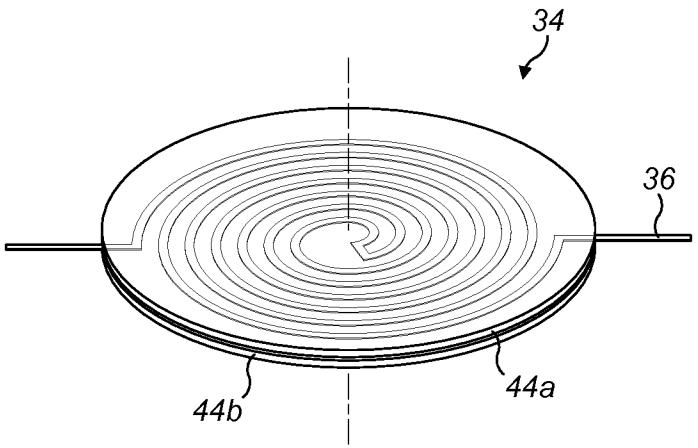
FIGS. 4*a* and 4*b* are diagrammatic illustrations of a second example of a low-pass filter of the induction heating assembly of FIGS. 1 and 2.
Figure 4A:
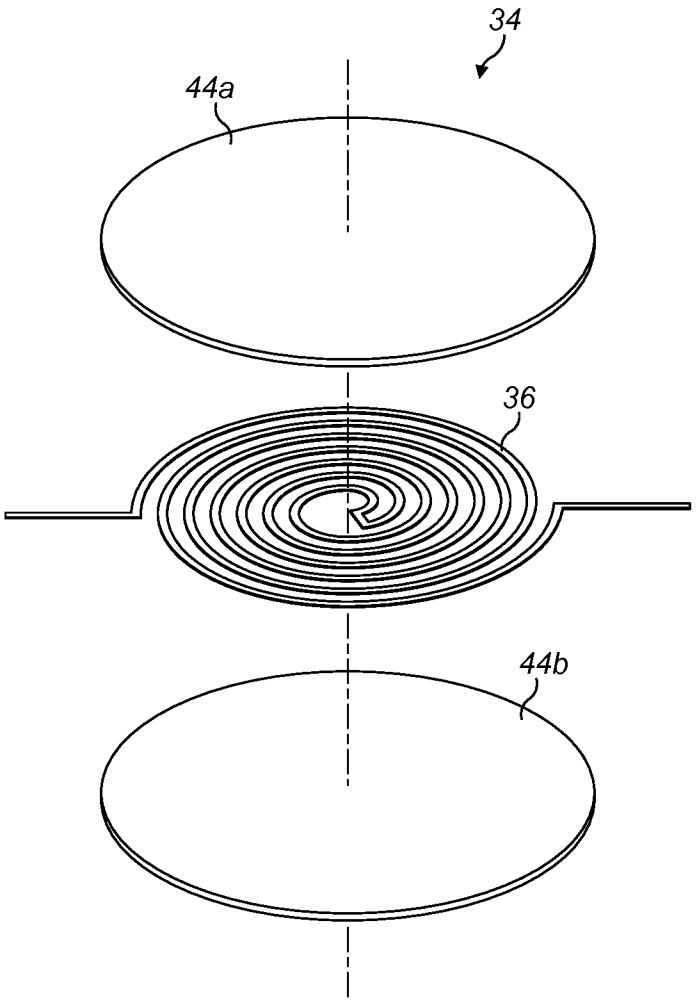

FIGS. 4*a* and 4*b* illustrate a further embodiment of the low-pass filter 34, similar to the low-pass filter 34 illustrated in FIGS. 3*a* and 3*b*, in which the low-pass filter coil 36 is positioned between two ferrimagnetic plate members in the form of ferrimagnetic disks 44*a*, 44*b*. The use of two ferrimagnetic disks 44*a*, 44*b*, as opposed to one ferrimagnetic disk 44 as shown in FIGS. 3*a* and 3*b*, provides a further increase in the inductance of the low-pass filter 34.

The ferrimagnetic disks 44, 44*a*, 44*b* comprise a ferrimagnetic material having a low electrical conductivity and a high magnetic permeability. A ferrite ceramic is one example of a suitable material. Again, it will be understood by those skilled in the art that the part of the coil 36 that extends radially outwardly from the centre region of the coil 36 does not contact the underlying circumferentially extending parts of the coil 36 that lie beneath it.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An induction heating assembly for a vapour generating device, the induction heating assembly comprising:

an induction coil;

a low-pass filter positioned adjacent to the induction coil and shaped to extend substantially across at least one side of the induction coil to provide an electromagnetic shield for the induction coil;

a power source arranged to provide power to the induction coil; and a heating compartment in communication with an air outlet, wherein the low-pass filter is positioned between the induction coil and the power source, between the power source and an air inlet in communication with the heating compartment, or between the induction coil and a resonant capacitor.

2. An induction heating assembly for a vapour generating device, the induction heating assembly comprising:

an induction coil;

a low-pass filter positioned adjacent to the induction coil and shaped to extend substantially across at least one side of the induction coil to provide an electromagnetic shield for the induction coil, wherein the low-pass filter comprises a coil.

3. The induction heating assembly according to claim 2, further comprising:

a power source arranged to provide power to the induction coil; and a heating compartment in communication with an air outlet.

4. The induction heating assembly according to claim 3, wherein the low-pass filter is positioned between the induction coil and the power source.

5. The induction heating assembly according to claim 3, further comprising an air inlet in communication with the heating compartment, wherein the low-pass filter is positioned between the air inlet and the power source.

6. The induction heating assembly according to claim 2, further comprising a resonant capacitor, wherein the low-pass filter is positioned between the induction coil and the resonant capacitor.

7. The induction heating assembly according to claim 2, wherein the low-pass filter coil comprises a flat coil extending in a plane defined by a winding direction of the coil.

8. The induction heating assembly according to claim 7, wherein:

the induction coil is helical;

the low-pass filter coil is positioned at an axial end of the helical induction coil; and the plane of the low-pass filter coil is substantially perpendicular to an axial direction of the helical induction coil.

9. The induction heating assembly according to claim 2, wherein:

the induction coil is helical; and the low-pass filter is arranged to substantially cover an elongate side of the helical induction coil.

10. The induction heating assembly according to claim 2, wherein the low-pass filter comprises a plate member comprising a ferrimagnetic material and the low-pass filter coil is positioned on the plate member.

11. The induction heating assembly according to claim 2, wherein the low-pass filter comprises two plate members comprising a ferrimagnetic material and the low-pass filter coil is positioned between the plate members.

12. The induction heating assembly according to claim 10, wherein the ferrimagnetic material has a low electrical conductivity and a high magnetic permeability.

13. A vapour generating device comprising:

the induction heating assembly according to claim 2;

a power source arranged to provide power to the induction coil;

a heating compartment arranged to receive an induction heatable cartridge;

an air inlet arranged to provide air to the heating compartment; and an air outlet in communication with the heating compartment.

* * * * *